US011203128B2

(12) United States Patent
Fukasawa et al.

(10) Patent No.: US 11,203,128 B2
(45) Date of Patent: Dec. 21, 2021

(54) SLIT DEVICE AND SHEET MANUFACTURING APPARATUS

(71) Applicant: SEIKO EPSON CORPORATION, Tokyo (JP)

(72) Inventors: Masanao Fukasawa, Nagano (JP); Keisuke Yagi, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/998,002

(22) Filed: Aug. 20, 2020

(65) Prior Publication Data

US 2021/0053244 A1 Feb. 25, 2021

(30) Foreign Application Priority Data

Aug. 22, 2019 (JP) ..... JP2019-151836

(51) Int. Cl.
*B26D 1/15* (2006.01)
*B26D 7/06* (2006.01)

(52) U.S. Cl.
CPC ..... *B26D 1/151* (2013.01); *B26D 7/06* (2013.01)

(58) Field of Classification Search
CPC ..... B26D 1/151; B26D 1/225; B26D 7/06; B26D 9/00; B65H 35/02
See application file for complete search history.

(56) References Cited

U.S. PATENT DOCUMENTS 4,168,643 A * 9/1979 Takimoto ..... B26D 1/245 83/422
2015/0266693 A1* 9/2015 Kiriyama ..... B26D 7/18 83/107

FOREIGN PATENT DOCUMENTS

EP 1935589 A1 * 6/2008 ..... B26D 1/245
GB 2304695 A * 3/1997 ..... B65H 35/006
JP 2000-343492 A 12/2000

* cited by examiner

*Primary Examiner* — Stephen Choi
(74) *Attorney, Agent, or Firm* — Global IP Counselors, LLP

(57) ABSTRACT

A slit device including a first transport section which transports a web in a transport direction while nipping the web, a second transport section which is disposed in parallel with a direction intersecting the transport direction of the first transport section and which transports the web in the transport direction while nipping the web, and a cutting section which is disposed between the first transport section and the second transport section in a direction intersecting the transport direction and which cuts the web along the transport direction, in which a cutting position at which the web is cut by the cutting section is a position within a nipping area where the first transport section nips the web along the transport direction, or is a position downstream of the nipping area in the transport direction.

7 Claims, 6 Drawing Sheets

SLIT DEVICE AND SHEET MANUFACTURING APPARATUS

The present application is based on, and claims priority from JP Application Serial Number 2019-151836, filed Aug. 22, 2019, the disclosure of which is hereby incorporated by reference herein in its entirety.

BACKGROUND

1. Technical Field

The present disclosure relates to a slit device and a sheet manufacturing apparatus provided with the slit device.

2. Related Art

In the related art, as illustrated in JP-A-2000-343492, there is known a slit device provided with a rotary cropping blade that crops a web, a rotary receiving blade disposed on the opposite side of the web to face the cutting blade, a pair of pressing rollers provided on both sides of the cropping blade, and a pressing member provided on the receiving blade side to cooperate with the pair of pressing rollers to nip the web.

However, in the slit device, the cropping blade is disposed on the rotating shaft of the pair of pressing rollers and the receiving blade is disposed on the rotating shaft of the pressing member. Therefore, a cutting position at which the cropping blade and the receiving blade cut the web is positioned further upstream in the transport direction of the web than a nipping area in which the pressing rollers and the pressing member nip the web. Accordingly, since the cutting of the web is performed in a region in which the web is not nipped by the pressing rollers and the pressing member, there are problems in that the web is apt to buckle and the cutting accuracy is reduced.

SUMMARY

According to an aspect of the present disclosure, there is provided a slit device including a first transport section which transports a web in a transport direction while nipping the web, a second transport section which is disposed in parallel with a direction intersecting the transport direction of the first transport section and which transports the web in the transport direction while nipping the web, and a cutting section which is disposed between the first transport section and the second transport section in a direction intersecting the transport direction and which cuts the web along the transport direction, in which a cutting position at which the web is cut by the cutting section is a position within a nipping area where the first transport section nips the web along the transport direction, or is a position downstream of the nipping area in the transport direction.

In the slit device, the first transport section may be a first transport roller pair, and the second transport section may be a second transport roller pair.

In the slit device, the cutting section may be provided with a driving blade and a driven blade driven by rotation of the driving blade, the driving blade may be provided on a rotating shaft of a drive roller that is a roller of first transport roller pair, and a rotating shaft of the driven blade may be positioned downstream in the transport direction of a rotating shaft of the driven roller that is the other roller of the first transport roller pair.

In the slit device, the cutting position may be provided at a position overlapping the drive roller when viewed from a direction orthogonal to the transport direction.

In the slit device, the driven blade may be disposed on the second transport roller pair side with respect to the driving blade, the driven blade may form a trapezoid when viewed from the transport direction, and a size of a surface of the driven blade on the second transport roller pair side may be smaller than a size of a surface of the driven blade on the driving blade side.

In the slit device, a size of a surface of a roller of the second transport roller pair facing the first transport roller pair may be smaller than a size of a surface opposite to the surface facing the first transport roller pair.

According to another aspect of the present disclosure, there is provided a sheet manufacturing apparatus including the slit device.

DESCRIPTION OF EXEMPLARY EMBODIMENTS

1. Slit Device 100

First, the configuration of a slit device 100 will be described.

Figure 1:
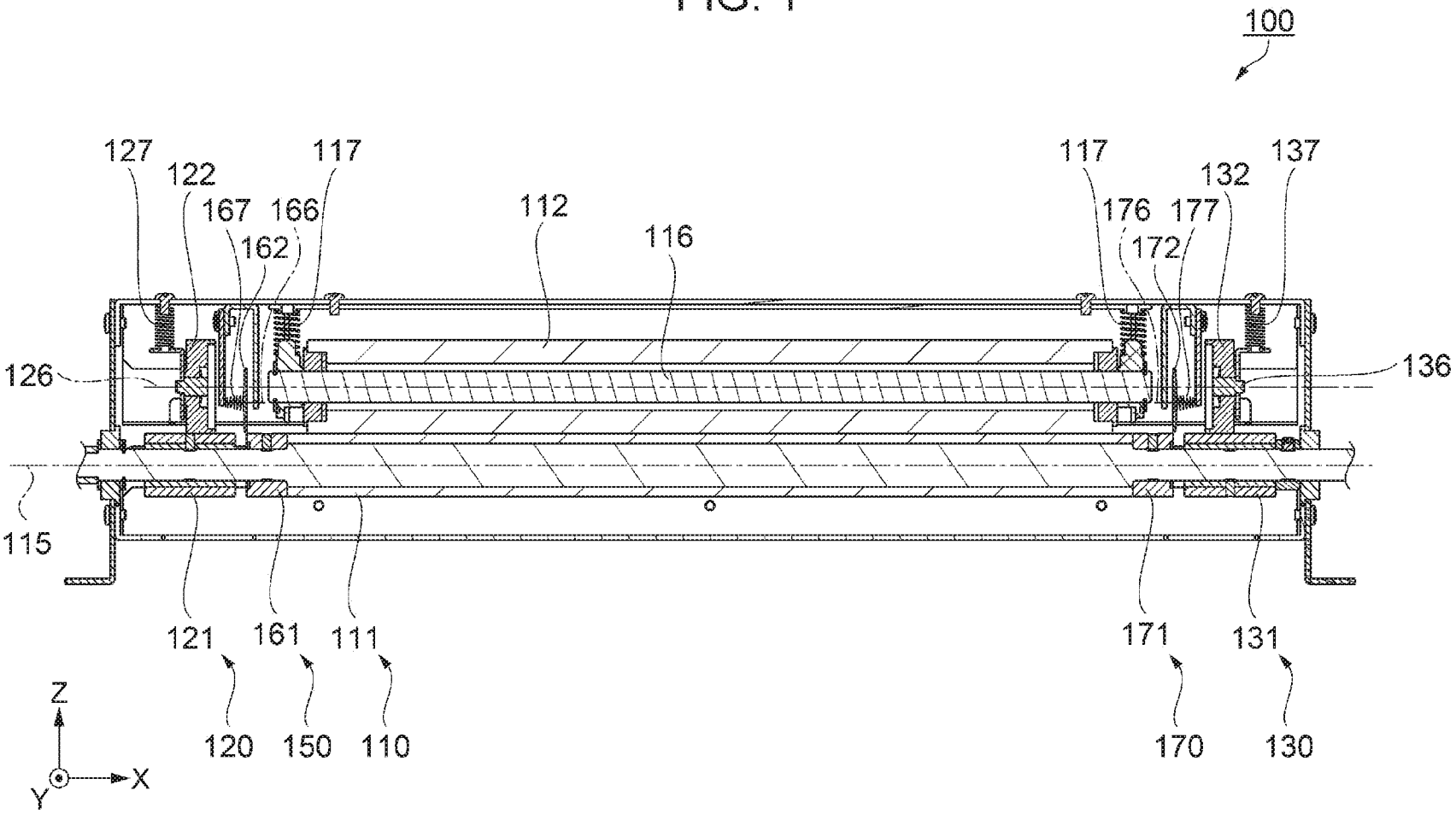
FIG. 1 is a front sectional diagram illustrating a configuration of a slit device.
Figure 2:
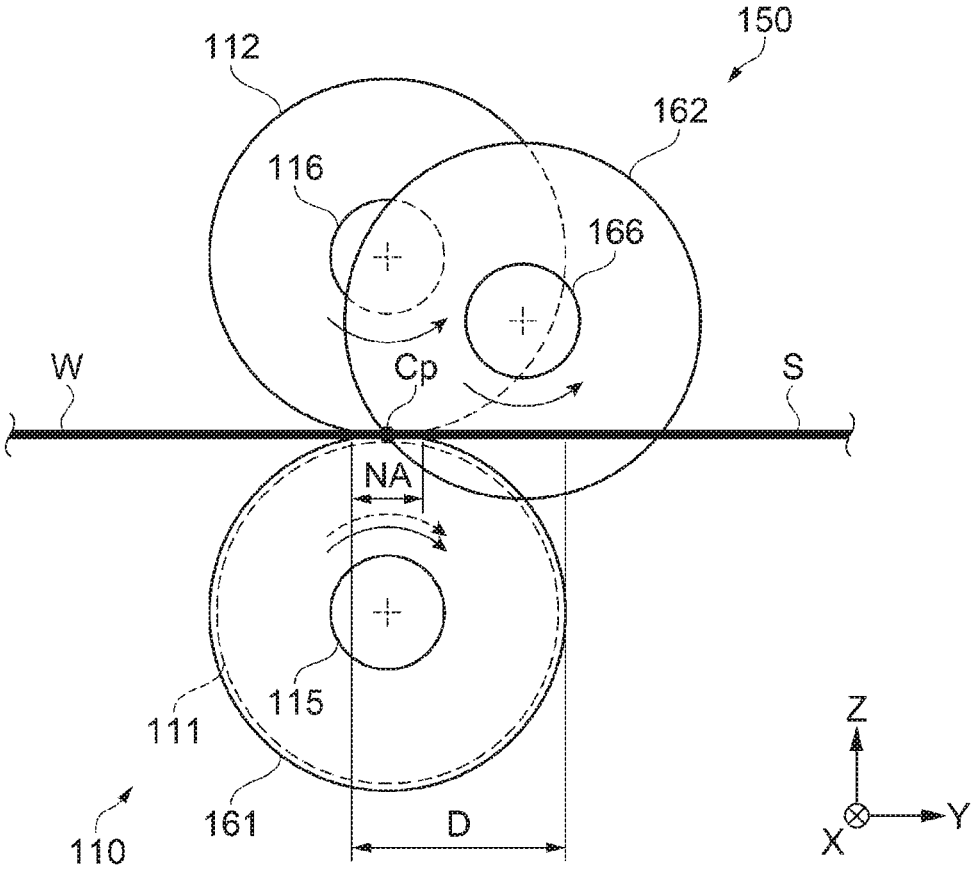
FIG. 2 is a partial side view illustrating the configuration of the slit device.
Figure 3:
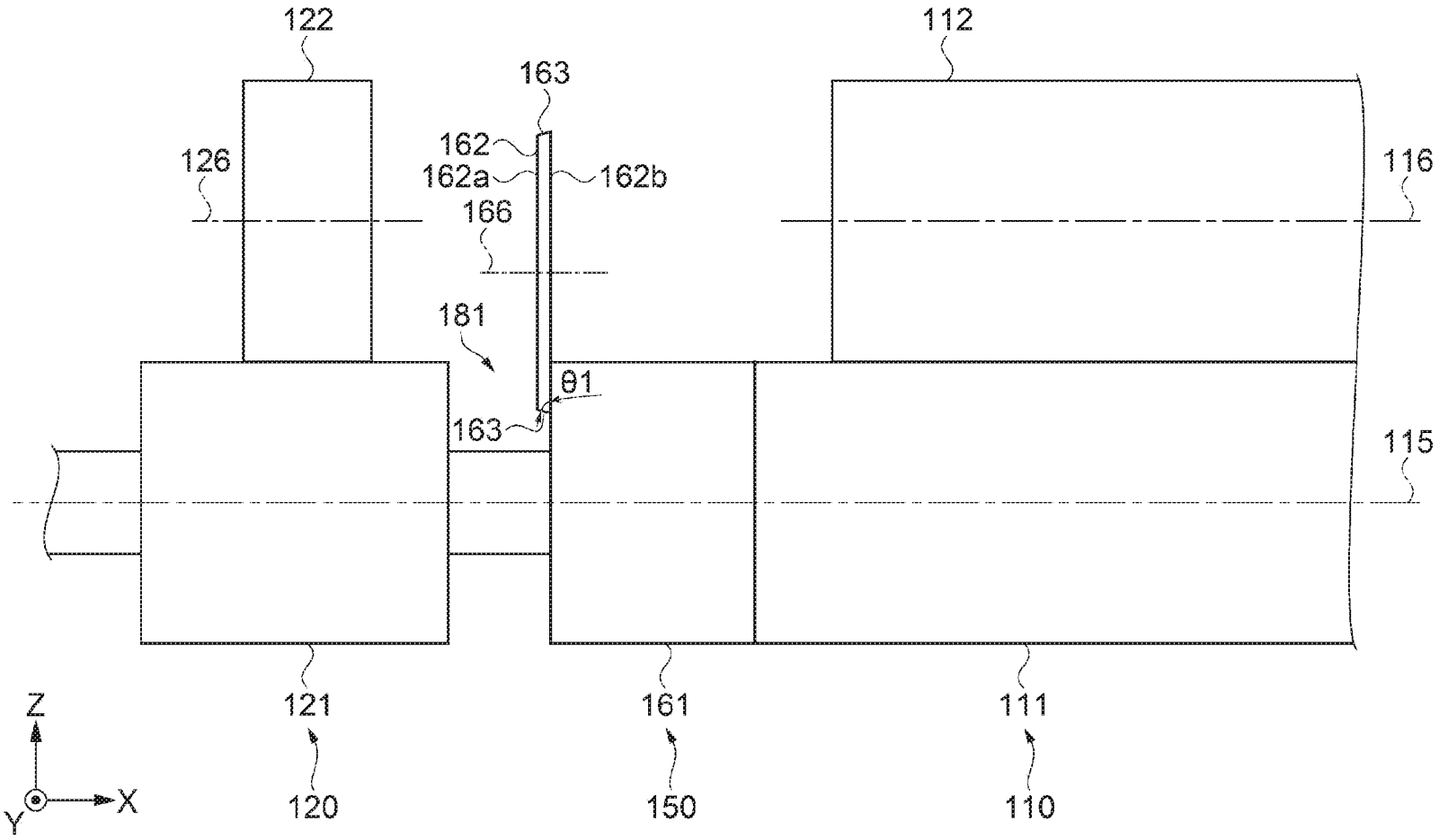
FIG. 3 is an enlarged view illustrating the configuration of a cutting section and the periphery of the cutting section.
Figure 4:
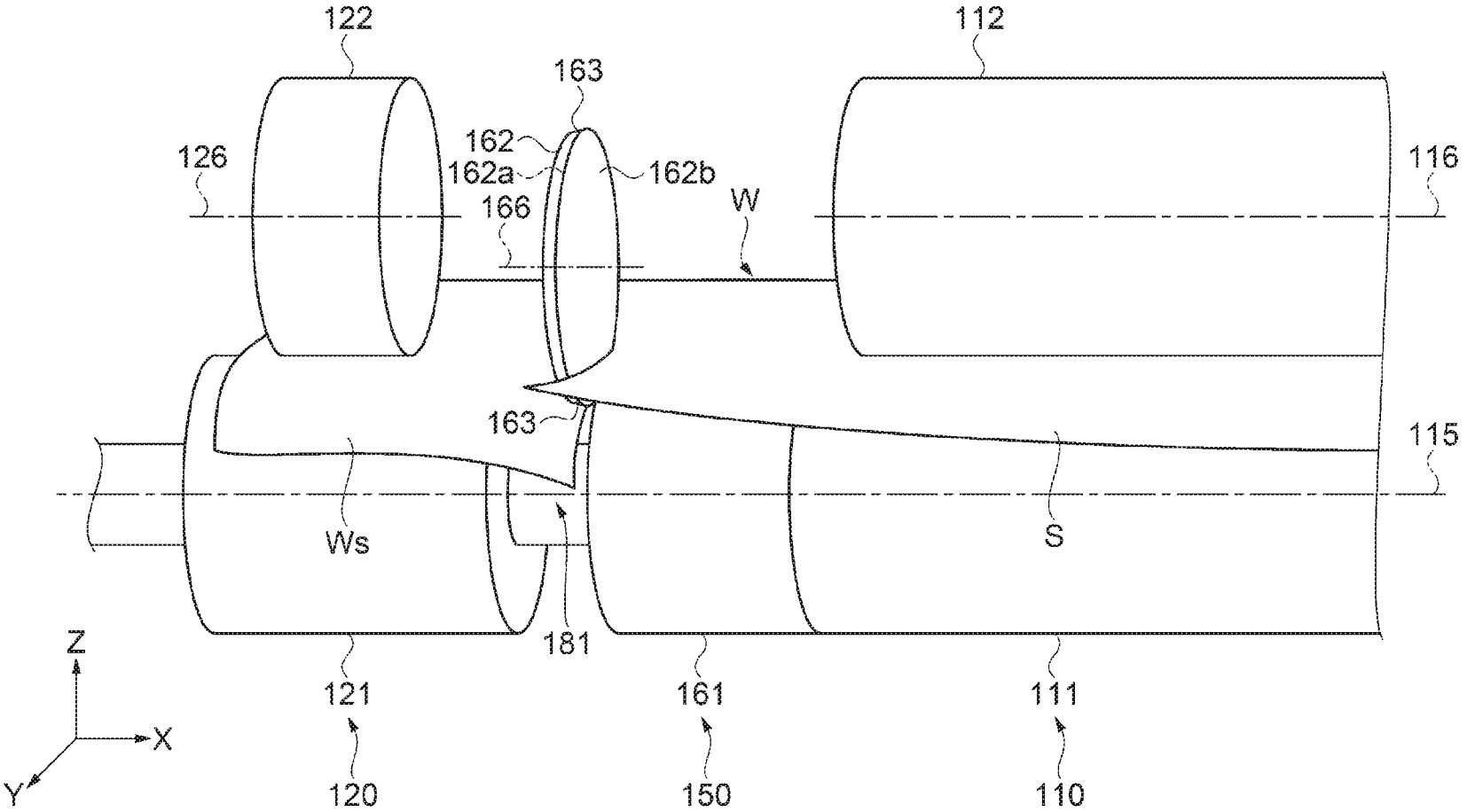
FIG. 4 is an explanatory diagram illustrating the operation of the slit device.

FIG. 1 is a front sectional view illustrating the configuration of the slit device 100 and FIG. 2 is a partial side view illustrating the configuration of the slit device 100. FIG. 3 is an enlarged view illustrating the configuration of a cutting section 150 and the periphery of the cutting section 150 and FIG. 4 is an explanatory diagram illustrating the operation of the slit device 100.

The slit device 100 is provided with a first transport section 110, a second transport section 120, and the cutting section 150. The first transport section 110 transports a web W in a transport direction while nipping the web W, the second transport section 120 is disposed parallel to a direction intersecting the transport direction of the first transport section 110 and transports the web W in the transport direction while nipping the web W, and the cutting section 150 is disposed between the first transport section 110 and the second transport section 120 in a direction intersecting the transport direction and cuts the web W along the transport direction.

The slit device 100 is a device that cuts and removes a portion of the web W which is a non-woven fabric or the like using the cutting section 150 and forms a sheet S of a desired size. In the present embodiment, both ends of the transported cut-sheet web W are cut by the cutting section 150 to form the sheet S of a desired size.

In the present embodiment, the transport direction of the web W corresponds to a +Y direction and the direction intersecting the transport direction corresponds to the direction along an X axis. A direction along a Z axis corresponds to the vertical direction of the slit device 100.

As illustrated in FIG. 1, the first transport section 110 of the present embodiment is a first transport roller pair and is configured to include a first main lower roller 111 and a first main upper roller 112 provided above the first main lower roller 111. The second transport section 120 disposed adjacent to the first transport section 110 in the −X direction is a second transport roller pair and is configured to include a second sub-lower roller 121 and a second sub-upper roller 122 provided above the second sub-lower roller 121. By using the first transport section 110 and the second transport section 120 as the first transport roller pair and the second transport roller pair, the frictional resistance during transport of the web W is reduced and it is possible to improve the transport properties and the cutting accuracy of the web W.

The first main lower roller 111 and the first main upper roller 112 extend along the X-axis direction and nip the web W from a center portion to the end portion side in a direction along the X-axis of the web W.

The first main lower roller 111 is a drive roller that rotates around a rotating shaft 115. The first main upper roller 112 is biased toward the first main lower roller 111 side by a biasing member 117. The first main upper roller 112 rotates around the rotating shaft 116. Accordingly, it is possible to transport the web W in a state in which the web W is nipped between the first main lower roller 111 and the first main upper roller 112. In the present embodiment, a portion where the web W is nipped between the first main lower roller 111 and the first main upper roller 112, that is, a portion where the web W is nipped along the transport direction corresponds to the nipping area NA. The biasing member 117 is a spring member, for example.

The second sub-lower roller 121 and the second sub-upper roller 122 nip the end portion of the web W in the direction along the X axis.

The second sub-lower roller 121 is a drive roller that rotates around the rotating shaft 115 in the same manner as the first main lower roller 111. The outer diameter dimension of the second sub-lower roller 121 is the same as the outer diameter dimension of the first main lower roller 111. The second sub-upper roller 122 is biased toward the second sub-lower roller 121 side by a biasing member 127. The outer diameter dimension of the second sub-upper roller 122 is the same as the outer diameter dimension of the first main upper roller 112. The second sub-upper roller 122 rotates around a rotating shaft 126. Accordingly, it is possible to transport the web W in a state in which the web W is nipped between the second sub-lower roller 121 and the second sub-upper roller 122. In the present embodiment, a portion where the web W is nipped between the second sub-lower roller 121 and the second sub-upper roller 122, that is, a portion where the web W is nipped along the transport direction corresponds to the nipping area NA. The biasing member 127 is a spring member, for example.

Here, the second sub-lower roller 121 and the first main lower roller 111 are disposed on the rotating shaft 115, and the axial center positions of the rotating shaft 126 of the second sub-upper roller 122 and the rotating shaft 116 of the first main upper roller 112 are positions on the same axis.

In the present embodiment, a second transport section 130 is disposed adjacent to the first transport section 110 in the +X direction. The second transport section 130 is a second transport roller pair and is configured to include a second sub-lower roller 131 and a second sub-upper roller 132 provided above the second sub-lower roller 131. The second sub-upper roller 132 is biased toward the second sub-lower roller 131 by a biasing member 137. The biasing member 137 is a spring member, for example. The second sub-lower roller 131 is a drive roller that rotates around the rotating shaft 115 and the second sub-upper roller 132 is a driven roller that rotates around a rotating shaft 136. The axial center positions of the rotating shaft 136 of the second sub-upper roller 132 and the rotating shaft 116 of the first main upper roller 112 are on the same axis.

In the slit device 100 according to the present embodiment, the second transport sections 120 and 130 are disposed corresponding to both end portions of the web W in the direction intersecting the transport direction of the web W. Accordingly, it is possible to transport the entirety of the web W in the transport direction using the first transport section 110 and the second transport sections 120 and 130. Since the configuration of the second transport section 130 is the same as the configuration of the second transport section 120, detailed description thereof will be omitted.

The first main lower roller 111, the first main upper roller 112, the second sub-lower rollers 121 and 131, and the second sub-upper rollers 122 and 132 are conductive. For example, the first main lower roller 111 and the second sub-lower rollers 121 and 131 are conductive rubber members, the first main upper roller 112 is a metal member, and the second sub-upper rollers 122 and 132 are curable conductive resin members. As a result, since the surface of a cut piece Ws cut by the cutting section 150 is electrically neutralized, adherence of the cut piece Ws to the second transport sections 120 and 130 is suppressed and it is possible to suppress transporting problems such as jams. Further, since the surface of the sheet S transported by the first transport section 110 is also electrically neutralized, it is possible to suppress transporting problems such as jams.

The second sub-upper rollers 122 and 132 may be metal members.

The cutting section 150 cuts the transported web W along the transport direction.

The cutting section 150 of the present embodiment includes a driving blade 161, and a driven blade 162 that is driven by the rotation of the driving blade 161. The driving blade 161 is disposed adjacent to the −X direction end of the first main lower roller 111. The driven blade 162 has a thin disc shape and is disposed on the side of the second transport roller pair which configures the second transport section 120 with respect to the driving blade 161.

The driving blade 161 rotates around the rotating shaft 115 in a similar manner to the first main lower roller 111 corresponding to one drive roller of the first transport roller pair. The driving blade 161 has a cylindrical shape and the outer diameter dimension thereof is the same as the outer diameter dimension of the first main lower roller 111. The driven blade 162 is biased toward the −X direction end surface side of the driving blade 161 by a biasing member 167. The driven blade 162 rotates around a rotating shaft 166. Accordingly, the driven blade 162 cuts the web W while being biased toward the end surface of the driving blade 161. The outer diameter dimension of the driven blade 162 is the same as the outer diameter dimension of the first main upper roller 112. In the present embodiment, the position where the driving blade 161 and the driven blade 162 cut the web W corresponds to a cutting position Cp. At the cutting position Cp, the driven blade 162 is biased in a state of being slightly inclined with respect to the driving blade 161 such that the driving blade 161 and the blade edge of the driven blade 162 make point contact. The biasing member 167 is a spring member, for example.

In the present embodiment, a cutting section 170 is also disposed in the +X direction of the first transport section 110. The cutting section 170 is provided with a driving blade 171 that rotates around the rotating shaft 115 and a driven blade 172 that rotates around a rotating shaft 176. The driven blade 172 is biased toward the end surface side of the driving blade 171 by a biasing member 177.

In other words, the slit device 100 according to the present embodiment is configured such that the cutting sections 150 and 170 are disposed corresponding to both end portions of the web W in the direction intersecting the transport direction of the web W, it is possible to cut both end portions of the web W to be transported by the first transport section 110 and the second transport sections 120 and 130. Since the configuration of the cutting section 170 is the same as the configuration of the cutting section 150 the description thereof will be omitted.

As illustrated in FIG. 2, the cutting position Cp at which the cutting section 150 cuts the web W is positioned within the nipping area NA in which the first transport section 110 nips the web W along the transport direction.

Specifically, the driving blade 161 is provided on the rotating shaft 115 and the center of the rotating shaft 166 of the driven blade 162 is positioned on downstream in the transport direction of the center of the rotating shaft 116 of the first main upper roller 112 which serves as the other driven roller of the first transport roller pair. Accordingly, the cutting position Cp at which the driving blade 161 and the driven blade 162 cut the web W is positioned within the nipping area NA.

Therefore, the web W is cut in the region in which the web W is nipped by the first transport section 110 and the second transport section 120 in the direction intersecting the transport direction of the web W. In other words, the web W is nipped from both sides interposing the cutting section 150 and the web W is cut in a stable state due to the nipping. The form in which the web W is nipped by the first transport section 110 and the second transport section 130 and the web W is cut by the cutting section 170 is similar to the above. Accordingly, buckling of the web W is suppressed and it is possible to improve the cutting accuracy.

The cutting position Cp of the cutting section 150 is also positioned within the nipping area NA in which the second transport section 120 nips the web W.

By providing the driving blade 161 on the rotating shaft 115 and positioning the rotating shaft 166 of the driven blade 162 downstream of the rotating shaft 116 of the first main upper roller 112 in the transport direction, it is possible to easily position the cutting position Cp within the nipping area NA or downstream of the nipping area NA in the transport direction.

It is preferable that the cutting position Cp at which the web W is cut by the cutting section 150 be positioned within the nipping area NA at which the first main lower roller 111 and the first main upper roller 112 nip the web W along the transport direction. This is because, as described above, it is possible to cut the web W in a state in which the web W is reliably nipped.

The cutting position Cp may be positioned downstream of the nipping area NA in the transport direction.

In this case, the cutting position Cp is provided at a position overlapping the first main lower roller 111 which serves as a drive roller when viewed from the direction orthogonal to the transport direction. In other words, as illustrated in FIG. 2, the cutting position Cp may be positioned within a distance dimension D from the upstream end in the transport direction of the nipping area NA to the downstream end in the transport direction of the first main lower roller 111 in the transport direction along the Y axis. More preferably, when the cutting position Cp is within the distance dimension D/2 from the upstream end in the transport direction of the nipping area NA to the downstream end in the transport direction of the first main lower roller 111 in the transport direction along the Y axis, it is possible to perform more stable cutting. Even in this case, it is possible to cut the web W in a state in which the web W is nipped between the first transport section 110 and the second transport section 120.

Next, the form of the driven blade 162 of the cutting section 150 will be described.

The driven blade 162 has a thin truncated cone shape. As illustrated in FIG. 3, the driven blade 162 has a substantially trapezoidal shape when viewed from the direction along the Y axis. The size of a surface 162*a* of the driven blade 162 on the side of the second transport roller pair (the second transport section 120) is smaller than the size of a surface 162*b* of the driven blade 162 on the driving blade 161 side. An inclined surface 163 is formed between the surface 162*a* and the surface 162*b*.

Here, the angle θ1 formed by the surface 162*b* of the driven blade 162 and the inclined surface 163 is 70 degrees to 80 degrees and can be appropriately set depending on the thickness, the material, and the like of the web W. In the present embodiment, for example, when cutting the nonwoven fabric sheet S having a thickness of approximately 0.07 mm to 0.1 mm, the angle θ1 is set to approximately 75 degrees.

A gap 181 is formed between the lower tip portion of the driven blade 162 and the second sub-lower roller 121. The gap 181 functions as an escape groove for diverting a portion of the cut piece Ws cut by the cutting section 150 to the lower side of the gap 181.

Next, the operation of the slit device 100 will be described. FIG. 4 illustrates a state in which the web W transported by the cutting section 150 is cut.

As illustrated in FIG. 4, when the web W is cut by the cutting section 150, the sheet S is transported downstream by the first transport section 110, and in the second transport section 120, the cut piece Ws obtained by cutting the end portion of the web W is transported downstream.

Here, the nipping pressure at which the web W is nipped between the first main lower roller 111 and the first main upper roller 112, is higher than each nipping pressure at which the web W is nipped between the second sub-lower rollers 121 and 131 and the second sub-upper rollers 122 and 132. This is because the entirety of the center portion of the web W is transported by the first main lower roller 111 and the first main upper roller 112 and the second sub-lower rollers 121 and 131 and the second sub-upper rollers 122 and 132 transport the end portions of the web W in a supplementary manner. Due to the difference in nipping pressure, it is possible to cause the transport orientation of the sheet S obtained after the web W is cut and that of the cut piece Ws to be different. Specifically, after cutting the web W, the downstream end portion of the sheet S that passes through the first main lower roller 111 and the first main upper roller 112, which have a relatively high nipping pressure, is transported upward. On the other hand, the downstream end portions of the cut pieces Ws which pass through the second sub-lower rollers 121 and 131 and the second sub-upper rollers 122 and 132, which have a relatively low nip pressure, is transported horizontally or downward. Accordingly, the sheet S and the cut pieces Ws are easily separated.

When the web W is cut by the cutting section 150, the +X-axis direction end portion of the cut piece Ws, that is, the portion of the cut piece Ws that is not nipped by the second transport section 120 is guided and transported downward along the inclined surface 163 of the driven blade 162. The +X axis direction end portion of the cut piece Ws that is diverted downward is contained in the gap 181. The cut piece Ws is transported downward.

On the other hand, when the web W is cut by the cutting section 150, the −X axis direction end portion of the sheet S is in contact with the surface 162*b* of the driven blade 162 and is guided and transported upward by the rotation of the driven blade 162.

Therefore, it is possible to cause the transport directions of the sheet S and the cut pieces Ws to be different from each other downstream in the transport direction, to suppress the mixing of the sheet S and the cut piece Ws, and to easily separate the sheet S and the cut piece Ws from each other.

In the above description, although the cutting section 150 on one side of the slit device 100 is described as an example, the same applies to the other cutting section 170.

2. Sheet Manufacturing Apparatus 1

Figure 5:
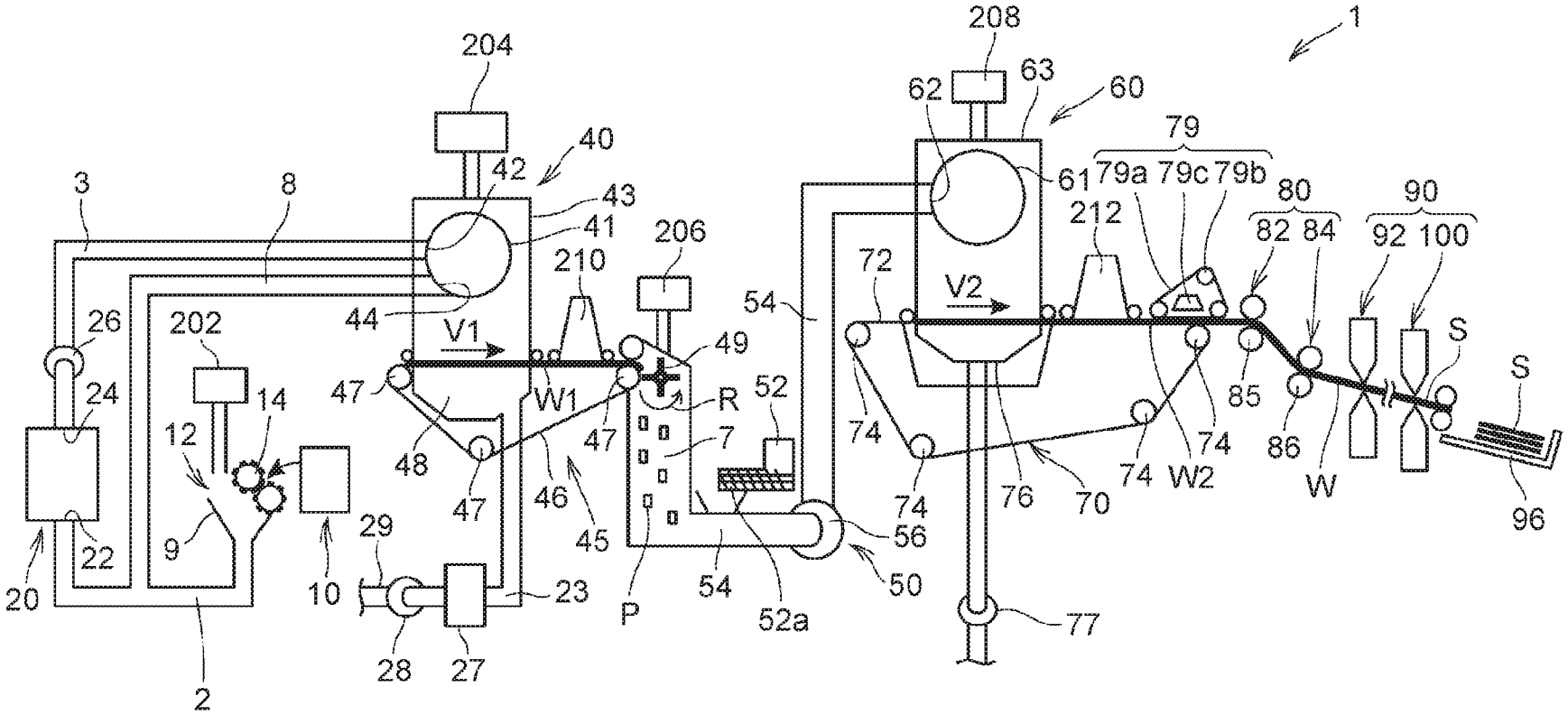
FIG. 5 is a schematic diagram illustrating a configuration of a sheet manufacturing apparatus.

Next, the configuration of the sheet manufacturing apparatus 1 provided with the slit device 100 will be described. FIG. 5 is a schematic diagram illustrating the configuration of the sheet manufacturing apparatus 1.

The sheet manufacturing apparatus 1 is an apparatus suitable for manufacturing new paper, for example, by defibrating used waste paper as a feedstock in a dry system to form fibers and subsequently pressurizing, heating, and cutting the result. By mixing various additives into the fibrous feedstock, the binding strength and whiteness of paper products may be improved and color, fragrance, and functions such as and flame retardancy may be added according to the application. By controlling the density, thickness, and shape of the paper, it is possible to manufacture paper of various thicknesses and sizes according to the application, such as A4 or A3 office paper, business card paper, and the like.

The sheet manufacturing apparatus 1 includes a supply section 10, a crushing section 12, a defibrating section 20, a sorting section 40, a first web forming section 45, a rotating body 49, a mixing section 50, an accumulating section 60, a second web forming section 70, a transport section 79, a sheet forming section 80, and a shearing section 90. The shearing section 90 includes the slit device 100.

The sheet manufacturing apparatus 1 includes, for example, humidifying sections 202, 204, 206, 208, 210 and 212 for the purpose of humidifying the feedstock and humidifying the space in which the feedstock moves. Humidification suppresses adherence of feedstocks caused by static electricity. The humidifying sections 202, 204, 206, and 208 are, for example, configured by vaporization or warm air vaporization humidifiers. The humidifying sections 210 and 212 are, for example, configured by ultrasonic wave humidifiers.

The supply section 10 supplies the feedstock to the crushing section 12. The feedstock supplied to the crushing section 12 may be any material containing fibers, and examples thereof include paper, pulp, pulp sheet, non-woven fabric, fabric, and woven fabric. Hereinafter, a configuration is exemplified in which the sheet manufacturing apparatus 1 uses waste paper as the feedstock. The supply section 10 includes, for example, a stacker that stacks and accumulates waste paper and an automatic feeding device that sends the waste paper from the stacker to the crushing section 12.

The crushing section 12 shears the feedstock supplied by the supply section 10 with a crushing blade 14 to form crushed pieces. The crushing blade 14 shears the feedstock in a gas such as the atmosphere. The crushing section 12 includes, for example, a pair of crushing blades 14 that interpose and shear the feedstock therebetween and a drive section that rotates the crushing blade 14, and it is possible to adopt the same configuration as a so-called shredder. The shape and size of the crushed pieces are arbitrary and any shape and size be suitable for the defibrating process in the defibrating section 20 is satisfactory. The crushing section 12 shears the feedstock into pieces of paper having a size of 1 cm to several cm square or smaller, for example. The crushed pieces sheared by the crushing section 12 pass through a tube 2 via a chute 9 and are transported to the defibrating section 20.

The defibrating section 20 defibrates the crushed material sheared by the crushing section 12. More specifically, the defibrating section 20 subjects the feedstock sheared by the crushing section 12 to a defibrating process and generates defibrated matter. Here, "to defibrate" means to unravel the feedstock, which is formed by binding a plurality of fibers, into individual fibers. The defibrating section 20 has a function of separating substances such as resin particles, ink, toner, and anti-bleeding agent attached to the feedstock from the fibers.

The matter is referred to as defibrated matter after passing through the defibrating section 20. The defibrated matter includes, in addition to the unraveled and defibrated fibers, resin particles separated from the fibers when the fibers are unraveled, that is, resin particles for binding a plurality of fibers to each other, coloring materials such as ink and toner, and additives such as an anti-bleeding agent and a paper strength enhancer. The shape of the unraveled defibrated matter is string shaped or flat string shaped. The unraveled defibrated matter may be present in a state in which the defibrated matter is not entangled with other defibrated fibers, that is, in an independent state, or may be present in a state in which the defibrated matter is entangled with other defibrated matter to form a clumps, that is, in a state of forming clumps.

The defibrating section 20 performs defibration in a dry system. Here, performing the process of defibration or the like in a gas such as in the atmosphere, rather than in a liquid, is referred to as a dry system. The defibrating section 20 is configured using an impeller mill, for example. Specifically, although not illustrated, the defibrating section 20 includes a rotor that rotates at a high speed and a liner positioned on the outer circumference of the rotor. The crushed pieces sheared by the crushing section 12 are nipped between the rotor and the liner of the defibrating section 20 to be defibrated. The defibrating section 20 generates an air current by the rotation of the rotor. With this air current, the defibrating section 20 is capable of sucking the crushed pieces, which is a feedstock, from the tube 2 via an inlet 22 and transporting the defibrated matter to a discharge port 24. The defibrated matter is sent from the discharge port 24 to the tube 3 and is transported to the sorting section 40 via the tube 3. In the illustrated example, the sheet manufacturing apparatus 1 is provided with a defibrating blower 26 that is an air current generation device, and the defibrated matter is transported to the sorting section 40 by the air current generated by the defibrating blower 26.

The sorting section 40 is provided with an inlet 42 into which the defibrated matter defibrated by the defibrating section 20 flows from the tube 3 together with the air current. The sorting section 40 sorts the defibrated matter introduced into the inlet 42 according to the length of the fibers. Specifically, the sorting section 40 sorts the defibrated matter defibrated by the defibrating section 20 into defibrated matter of less than or equal to a predetermined size as a first sorted matter and defibrated matter larger than the first sorted matter as a second sorted matter. The first sorted matter contains fibers, particles, or the like and the second sorted matter contains, for example, large fibers, non-defibrated pieces, insufficiently defibrated crushed pieces, clumps in which defibrated fibers agglomerate or become entangled.

The sorting section 40 includes, for example, a drum section 41 and a housing section 43 that contains the drum section 41.

The drum section 41 is a cylindrical sieve that is rotationally driven by a motor. The drum section 41 includes a mesh and functions as a sieve. The drum section 41 uses the openings in the mesh to sort the defibrated matter into the first sorted matter having a smaller mesh opening size and the second sorted matter having a larger mesh opening size. It is possible to use expanded metal obtained by extending a notched metal plate, or a punching metal in which holes are formed in a metal plate by a press machine or the like as the mesh of the drum section 41, for example.

The defibrated matter introduced into the inlet 42 is sent into the inner portion of the drum section 41 together with the air current and the first sorted matter falls downward from the openings in the mesh of the drum section 41 due to the rotation of the drum section 41. The second sorted matter that may not pass through the mesh of the drum section 41 is caused to flow by the air current flowing from the inlet 42 into the drum section 41, guided to a discharge port 44, and sent out to the tube 8. The tube 8 couples the inner portion of the drum section 41 and the tube 2 to each other. The second sorted matter caused to flow through the tube 8 is returned to the defibrating section 20 and subjected to a defibrating process.

The first sorted matter sorted by the drum section 41 passes through the openings in the mesh of the drum section 41, is dispersed in the air, and descends toward a mesh belt 46 of the first web forming section 45 positioned below the drum section 41.

The first web forming section 45 includes the mesh belt 46, rollers 47, and a suction section 48. The mesh belt 46 is an endless belt, is suspended by three rollers 47, and is transported in the direction indicated by the arrow in the diagram by the movement of the rollers 47. The surface of the mesh belt 46 is configured by a mesh in which openings of a predetermined size are lined up. Of the first sorted matter descending from the sorting section 40, the fine particles of a size that passes through the openings in the mesh fall below the mesh belt 46, and fibers of a size that may not pass through the openings in the mesh are accumulated on the mesh belt 46 and transported in the arrow direction together with the mesh belt 46. The fine particles falling from the mesh belt 46 include those which are relatively small or relatively low density in the defibrated matter, that is, resin particles, coloring materials, additives, and the like unnecessary for binding the fibers to each other, and are removed matter that the sheet manufacturing apparatus 1 does not use for manufacturing the sheet S.

The mesh belt 46 moves at a constant speed V1 during ordinary operation of manufacturing the sheet S. Here, "during ordinary operation" refers to the time during the operation excluding the time during the execution of startup control and stopping control of the sheet manufacturing apparatus 1, and more specifically, the time during which the sheet manufacturing apparatus 1 manufactures the sheet S of a desired quality.

The suction section 48 sucks air from below the mesh belt 46. The suction section 48 is coupled to a dust collecting section 27 via a tube 23. The dust collecting section 27 is a filter dust collector or a cyclone dust collector and separates fine particles from the air current. A collection blower 28 is installed downstream of the dust collecting section 27 and the collection blower 28 functions as a dust collecting suction section that sucks air from the dust collecting section 27. The air discharged by the collection blower 28 is discharged to the outside of the sheet manufacturing apparatus 1 via a tube 29.

In the transport path of the mesh belt 46, the humidifying section 210 supplies air containing mist to the downstream of the sorting section 40. The mist, which is fine particles of water generated by the humidifying section 210, descends toward a first web W1 and supplies water to the first web W1. Accordingly, the amount of water contained in the first web W1 is adjusted and it is possible to suppress adherence of fibers to the mesh belt 46 caused by static electricity.

The sheet manufacturing apparatus 1 includes the rotating body 49 that divides the first web W1 accumulated on the mesh belt 46. The first web W1 is separated from the mesh belt 46 at the position where the mesh belt 46 is folded back by the roller 47 and is divided by the rotating body 49.

The rotating body 49 includes plate-shaped blades and has a rotating blade shape that rotates. The rotating body 49 is disposed at a position at which the first web W1 which is peeled from the mesh belt 46 and the blades come into contact with each other. According to the rotation of the rotating body 49, for example, the rotation in the direction indicated by an arrow R in the diagram, the blades collide with the first web W1 separated from the mesh belt 46 and transported to divide the first web W1, and subdivided matter P is generated. The subdivided matter P divided by the rotating body 49 descends in the inner portion of the tube 7 and is transported to the mixing section 50 by the air current flowing in the inner portion of the tube 7.

The mixing section 50 includes an additive supply section 52 that supplies an additive containing a resin, a tube 54 that communicates with the tube 7 and through which an air current containing the subdivided matter P flows, and a mixing blower 56. The mixing section 50 mixes the additive containing the resin into the fibers which configure the subdivided matter P.

In the mixing section 50, an air current is generated by the mixing blower 56 and the subdivided matter P and the additive are transported while being mixed in the tube 54. The subdivided matter P is loosened in the process of flowing in the inner portion of the tube 7 and the tube 54 and assumes a finer fibrous form.

The additive supply section 52 is coupled to an additive cartridge (not illustrated) for accumulating the additive and supplies the additive in the inner portion of the additive cartridge to the tube 54. The additive supply section 52 stores the additive formed of fine powder or fine particles in the inner portion of the additive cartridge. The additive supply section 52 includes a discharge section 52*a* that sends the stored additive to the tube 54.

The additive supplied by the additive supply section 52 contains a resin for binding a plurality of fibers. The resin contained in the additive is a thermoplastic resin or a heat-curable resin, and examples thereof include AS resin, ABS resin, polypropylene, polyethylene, polyvinyl chloride, polystyrene, acrylic resin, polyester resin, polyethylene terephthalate, polyphenylene ether, polybutylene terephthalate, polyamide, polycarbonate, polyacetal, polyphenylene sulfide, and polyether ether ketone. Any of the resins may be used individually or in mixture as appropriate. In other words, the additive may include a single substance, may be a mixture, and may include a plurality of types of particle each configured by a single substance or a plurality of substances. The additive may be in the form of fibers or powder.

The resin contained in the additive is melted by heating and binds the plurality of fibers together. Therefore, the fibers are not bound to each other in a state in which the resin is mixed with the fibers and is not heated to a temperature at which the resin melts.

Due to the air current generated by the mixing blower 56, the subdivided matter P that descends in the tube 7 and the additive supplied by the additive supply section 52 are sucked into the inner portion of the tube 54 and pass through the inner portion of the mixing blower 56. According to the air current generated by the mixing blower 56 and the action of the rotating portions such as the blades of the mixing blower 56, the fibers configuring the subdivided matter P and the additive are mixed, and the mixture, that is, the mixture of the first sorted matter and the additive is transported to the accumulating section 60 through the tube 54.

The accumulating section 60 accumulates the defibrated matter defibrated by the defibrating section 20. More specifically, the accumulating section 60 introduces the mixture that passes through the mixing section 50 from an inlet 62, loosens the entangled defibrated matter, and causes the defibrated matter to fall while dispersing the defibrated matter in the air. When the additive resin supplied from the additive supply section 52 is fibrous, the accumulating section 60 loosens the entangled resin. Accordingly, the accumulating section 60 is capable of causing the mixture to accumulate on the second web forming section 70 with good uniformity.

The accumulating section 60 includes a drum section 61 and a housing section 63 that contains the drum section 61. The drum section 61 is a cylindrical sieve that is rotationally driven by a motor. The drum section 61 includes a mesh and functions as a sieve. Using the openings in the mesh, the drum section 61 allows fibers and particles smaller than the openings in the mesh to pass through and causes those than pass through to fall from the drum section 61. The configuration of the drum section 61 is the same as the configuration of the drum section 41, for example.

The second web forming section 70 is disposed below the drum section 61. The second web forming section 70 accumulates the passed matter that has passed through the accumulating section 60 to form a second web W2. The second web forming section 70 includes, for example, a mesh belt 72, rollers 74, and a suction mechanism 76.

The mesh belt 72 is an endless belt, is suspended by a plurality of rollers 74, and is transported in the direction indicated by the arrow in the diagram by the movement of the rollers 74. The mesh belt 72 is made of metal, resin, cloth, or non-woven fabric, for example. The surface of the mesh belt 72 is configured by a mesh in which openings of a predetermined size are lined up. Of the fibers and particles descending from the drum section 61, the fine particles of a size that passes through the openings in the mesh fall below the mesh belt 72, and fibers of a size that may not pass through the openings in the mesh are accumulated on the mesh belt 72 and transported in the arrow direction together with the mesh belt 72. The mesh belt 72 moves at a constant speed V2 during ordinary operation of manufacturing the sheet S.

The openings in the mesh of the mesh belt 72 are fine and it is possible to adopt a size at which the majority of the fibers and particles falling from the drum section 61 do not pass through.

The suction mechanism 76 is provided below the mesh belt 72. The suction mechanism 76 includes a suction blower 77 and it is possible to use the suction force of the suction blower 77 to generate an air current directed downward in the suction mechanism 76.

The suction mechanism 76 sucks the mixture dispersed in the air by the accumulating section 60 onto the mesh belt 72. Accordingly, it is possible to promote the formation of the second web W2 on the mesh belt 72 and the increasing of the discharge speed from the accumulating section 60. The suction mechanism 76 is capable of forming a downflow in the falling path of the mixture and is capable of preventing the defibrated matter and the additives from becoming entangled with each other during the falling.

As described above, the second web W2 is formed in a state of containing a large amount of air and is soft and bulged by passing through the accumulating section 60 and the second web forming section 70. The second web W2 accumulated on the mesh belt 72 is transported to the sheet forming section 80.

In the transport path of the mesh belt 72, the humidifying section 212 supplies air containing mist to the downstream of the accumulating section 60. Accordingly, the mist generated by the humidifying section 212 is supplied to the second web W2 and the amount of water contained in the second web W2 is adjusted. Accordingly, it is possible to suppress adherence of fibers to the mesh belt 72 caused by static electricity.

The sheet manufacturing apparatus 1 includes the transport section 79 that transports the second web W2 on the mesh belt 72 to the sheet forming section 80. The transport section 79 includes a mesh belt 79*a*, rollers 79*b*, and a suction mechanism 79*c*, for example.

The suction mechanism 79*c* is provided with a blower (not illustrated) and the suction force of the blower is used to generate an upward air current on the mesh belt 79*a*. The air current sucks the second web W2 and the second web W2 is separated from the mesh belt 72 and adheres to the mesh belt 79*a*. The mesh belt 79*a* moves by the rotation of the rollers 79*b* and transports the second web W2 to the sheet forming section 80.

In this manner, the transport section 79 peels the second web W2 formed on the mesh belt 72 from the mesh belt 72 and transports the second web W2.

The sheet forming section 80 forms the sheet S from the accumulated matter accumulated by the accumulating section 60. More specifically, the sheet forming section 80 pressurizes and heats the second web W2 accumulated on the mesh belt 72 and transported by the transport section 79 to form the sheet S. In the sheet forming section 80, the plurality of fibers in the mixture are bound to each other via the resin by applying heat to the fibers and additives of the defibrated matter contained in the second web W2.

The sheet forming section 80 includes a pressurizing section 82 that pressurizes the second web W2 and a heating section 84 that heats the second web W2 pressurized by the pressurizing section 82.

The pressurizing section 82 is configured by a pair of calender rollers 85 and interposes and pressurizes the second web W2 at a predetermined nip pressure. The thickness of the second web W2 is reduced by being pressurized and the density of the second web W2 is increased. One of the pair of calender rollers 85 is a drive roller driven by a motor (not illustrated) and the other is a driven roller. The calender rollers 85 are rotated by the driving force of the motor and transport the second web W2, which has a high density due to the pressurizing, toward the heating section 84.

The heating section 84 is configured by, for example, a heating roller, a heat press molding machine, a hot plate, a warm air blower, an infrared heater, a flash fixing device, and the like. In the illustrated example, the heating section 84 is provided with a pair of heating rollers 86. The heating rollers 86 are heated to a preset temperature by a heater installed on the inside or the outside thereof. The heating rollers 86 interpose the second web W2 pressurized by the calender rollers 85 to apply heat to form the sheet S.

One of the pair of heating rollers 86 is a drive roller driven by a motor (not illustrated) and the other is a driven roller. The heating rollers 86 are rotated by the driving force of the motor to transport the heated sheet S toward the shearing section 90.

In this manner, the second web W2 formed by the accumulating section 60 is pressurized and heated by the sheet forming section 80 to form the web W.

The shearing section 90 cuts the web W formed by the sheet forming section 80. The shearing section 90 includes a first shearing section 92 that cuts the web W in a direction intersecting the transport direction of the web W and the slit device 100 that cuts the web W that is formed into a cut sheet in the transport direction.

The slit device 100 includes the first transport section 110, the second transport sections 120 and 130, and the cutting sections 150 and 170. The detailed configuration of the slit device 100 is as described above.

The cutting position Cp of the web W in the cutting sections 150 and 170 is a position within the nipping area NA where the first transport section 110 nips the web W along the transport direction, or is a position further downstream in the transport direction than the nipping area NA. The cut piece Ws is removed from the web W by the slit device 100 and the sheet S which is a cut sheet of a predetermined size is formed.

Since the downstream end portion of the sheet S transported to the slit device 100 is transported upward, it is easy to transport the sheet S to the transport roller pair provided downstream of the slit device 100. On the other hand, the downstream ends of the cut pieces Ws are transported in the horizontal direction or downward. Accordingly, the intrusion of the cut pieces Ws into the transport roller pair provided downstream of the slit device 100 is suppressed.

The sheet S which is a formed cut sheet is discharged to a discharge section 96. The discharge section 96 includes a tray or a stacker on which the sheets S of a predetermined size are placed.

On the other hand, the cut pieces Ws cut by the slit device 100 are supplied to the crushing blade 14 again.

As described above, according to the sheet manufacturing apparatus 1, it is possible to manufacture the sheet S which is excellent in the cutting accuracy of the web W and has high quality.

In the above description, although the crushing section 12 first crushes the feedstock and the sheet S is manufactured from the crushed feedstock, for example, it is also possible to adopt a configuration in which the sheet S is manufactured by using the fibers as the feedstock.

For example, a configuration may be adopted in which the fibers that are equivalent to the defibrated matter that is defibrated by the defibrating section 20 are used as the feedstock and are inserted into the drum section 41. It is sufficient to adopt a configuration in which it is possible to insert, as the feedstock, the same fibers as the first sorted matter separated from the defibrated matter into the tube 54. In this case, it is possible to manufacture the sheet S by supplying the fibers obtained by processing waste paper or pulp to the sheet manufacturing apparatus 1.

3. Modification Example 1

In the above embodiment, although the second sub-upper roller 122 of the second transport section 120 has a cylindrical shape, the configuration not limited thereto.

Figure 6:
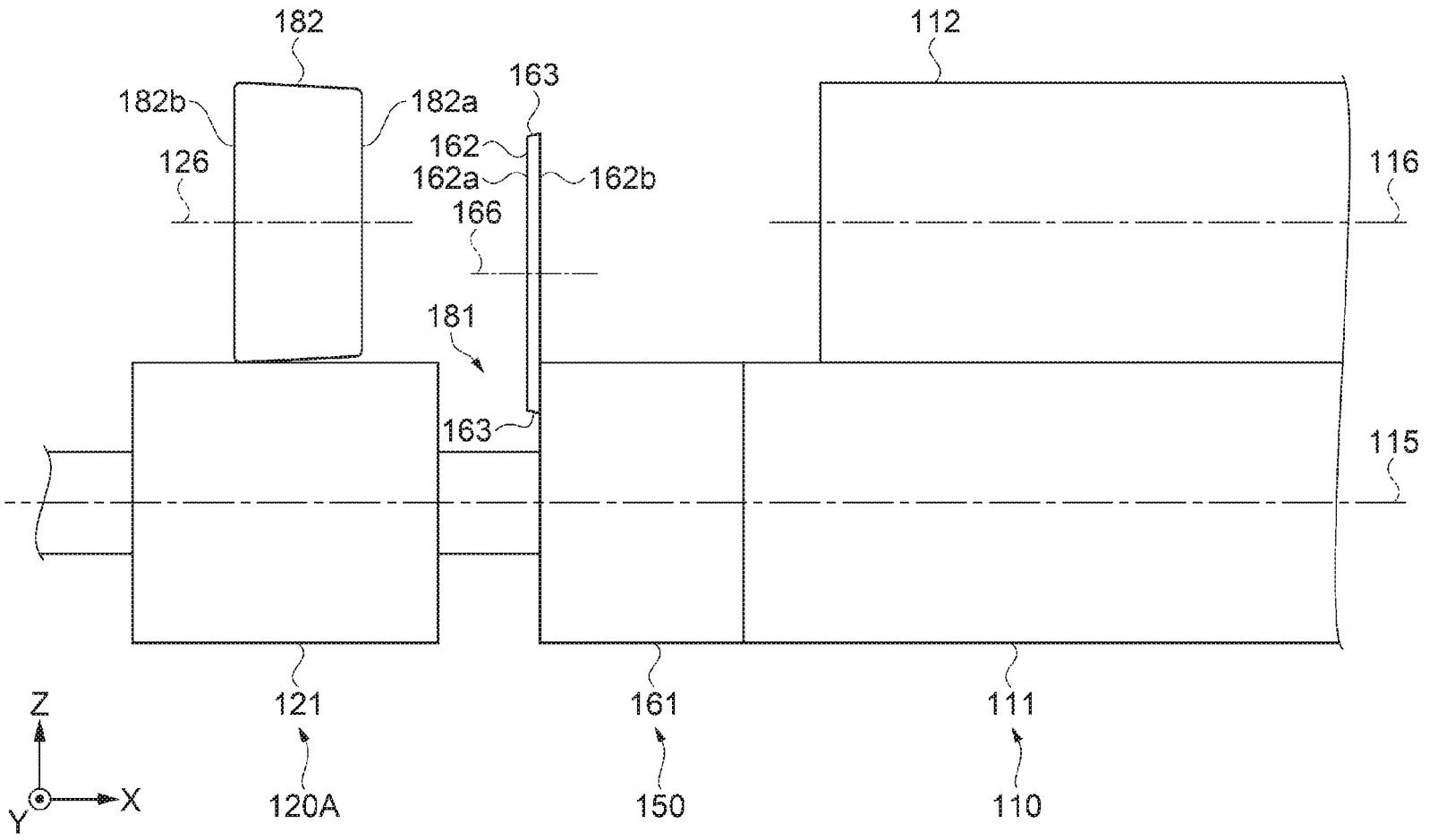
FIG. 6 is a schematic diagram illustrating a configuration of a second transport section according to a modification example.

FIG. 6 is a schematic diagram illustrating the configuration of a second transport section 120A according to the modification example.

A second sub-upper roller 182, which is one of the rollers of the second transport roller pair that configures the second transport section 120A, has a truncated cone shape, and as illustrated in FIG. 6, the size of a surface 182*a* facing the first transport roller pair (the first transport section 110) is smaller than a surface 182*b* opposite to the surface 182*a* facing the first transport roller pair (the first transport section 110).

Accordingly, the nipping pressure between the second sub-lower roller 121 and the second sub-upper roller 182 with respect to the web W is higher on the surface 182*b* side which is opposite to the surface 182*a* of the second sub-upper roller 182 as compared to on the surface 182*a* side facing the first transport section 110. Accordingly, it is possible to guide and transport the cut pieces Ws to the outside with respect to the transported sheet S. In other words, it is possible to change the transport directions of the cut pieces Ws with respect to the direction of the sheet S transported by the first transport section 110 after the cutting and to easily separate the cut pieces Ws from the sheet S.

4. Modification Example 2

In the above-described embodiment, although the cutting section 150 is configured by the driving blade 161 and the driven blade 162, the configuration is not limited thereto. For example, a cutter member capable of cutting the web W may be used. In this case, the tip end portion of the cutter member that cuts the web W assumes the cutting position Cp and the cutting position Cp is a position within the nipping area NA in which the first transport section 110 nips the web W along the transport direction, or is positioned downstream of the nipping area NA in the transport direction. Even in this case, it is possible to obtain a similar effect to that described above.

5. Modification Example 3

The second transport section 120 is configured by the second sub-lower roller 121 and the second sub-upper roller 122, but is not limited thereto. For example, a pressing plate may be used instead of the second sub-upper roller 122. In other words, a configuration may be adopted in which the web W is nipped and transported by the second sub-lower roller 121 and the pressing plate. Even in this case, it is possible to obtain a similar effect to that described above.

The content derived from the embodiment will be described below.

A slit device includes a first transport section which transports a web in a transport direction while nipping the web, a second transport section which is disposed in parallel with a direction intersecting the transport direction of the first transport section and which transports the web in the transport direction while nipping the web, and a cutting section which is disposed between the first transport section and the second transport section in a direction intersecting the transport direction and which cuts the web along the transport direction, in which a cutting position at which the web is cut by the cutting section is a position within a nipping area where the first transport section nips the web along the transport direction, or is a position downstream of the nipping area in the transport direction.

In this configuration, the web is cut in the region in which the web is nipped by the first transport section and the second transport section in the direction intersecting the transport direction of the web. More specifically, the cutting position of the cutting section is a position within the nipping area where the first transport section nips the web along the transport direction, or is a position downstream of the nipping area in the transport direction. In other words, the web is nipped from both sides interposing the cutting section and the web is cut in a stable state due to the nipping. Accordingly, buckling of the web is suppressed and it is possible to improve the cutting accuracy.

In the slit device, it is preferable that the first transport section be a first transport roller pair, and the second transport section be a second transport roller pair.

According to this structure, the frictional resistance at the time of transporting the web is reduced, and the transportability of the web can be improved.

In the slit device, it is preferable that the cutting section be provided with a driving blade and a driven blade driven by rotation of the driving blade, the driving blade be provided on a rotating shaft of a drive roller that is a roller of the first transport roller pair, and a rotating shaft of the driven blade be positioned downstream in the transport direction of a rotating shaft of a driven roller that is the other roller of the first transport roller pair.

In this configuration, it is possible to easily position the cutting position between the driven blade and the driving blade within the nipping area, or downstream of the nipping area in the transport direction.

In the slit device, it is preferable that the cutting position be provided at a position overlapping the drive roller when viewed from a direction orthogonal to the transport direction.

In this configuration, it is possible to cut the web in a state in which the web is being nipped by the first transport roller pair and the second transport roller pair.

In the slit device, it is preferable that the driven blade be disposed on the second transport roller pair side with respect to the driving blade, the driven blade form a trapezoid when viewed from the transport direction, and a size of a surface of the driven blade on the second transport roller pair side be smaller than a size of a surface of the driven blade on the driving blade side.

In this configuration, the blade edge of the driven blade has an inclined surface from the surface on the driving blade side to the surface on the second transport roller pair side. Accordingly, the web cut by the cutting section is guided and transported downward along the inclined surface of the driven blade. Therefore, it is possible to change the transport direction of the cut piece of the end portion of the web with respect to the direction of the web transported by the first transport roller pair after the cutting and to easily separate the cut piece.

In the slit device, it is preferable that a size of a surface of a roller of the second transport roller pair facing the first transport roller pair be smaller than a size of a surface opposite to the surface facing the first transport roller pair.

In this configuration, the nipping pressure on the web in the second transport roller pair is higher on the side of the surface opposite to the surface facing the first transport roller pair than on the side of the surface facing the first transport roller pair. Accordingly, for example, by disposing the first transport roller pair on the center side of the web and disposing the second transport roller pair on the end portion of the web, it is possible to guide and transport the cut piece at the end portion of the cut web to the outside. In other words, after cutting the web, it is possible to easily separate the cut piece from the web transported by the first transport roller pair.

A sheet manufacturing apparatus is provided with the slit device.

In this configuration, it is possible to manufacture a high-quality sheet having excellent web cutting accuracy.

What is claimed is:

1. A slit device comprising:

a first transport section which transports a web in a transport direction while nipping the web, the first transport section having a main upper member and a main lower member that nip the web;

a second transport section which is disposed in parallel with a direction intersecting the transport direction of the first transport section and which transports the web in the transport direction while nipping the web, the second transport section having a sub upper member and a sub lower member that nip the web;

a cutting section which is disposed between the first transport section and the second transport section in the direction intersecting the transport direction and which cuts the web along the transport direction;

a first biasing member which biases the main upper member of the first transport section to the main lower member of the first transport section; and a second biasing member which biases the sub upper member of the second transport section to the sub lower member of the second transport section, wherein a cutting position at which the web is cut by the cutting section is a position within a nipping area where the main upper member and the main lower member of the first transport section nip the web along the transport direction, or is a position downstream of the nipping area in the transport direction, and a nipping pressure at which the web is nipped between the main upper member and the main lower member of the first transport section by the first biasing member is higher than a nipping pressure at which the web is nipped between the sub upper member and the sub lower member of the second transport section by the second biasing member.

2. The slit device according to claim 1, wherein the first transport section is a first transport roller pair that includes one roller as the main lower member and an other roller as the main upper member, and the second transport section is a second transport roller pair that includes one roller as the sub lower member and an other roller as the sub upper member.

3. The slit device according to claim 2, wherein the cutting section is provided with a driving blade and a driven blade driven by rotation of the driving blade, the driving blade is provided on a rotating shaft of a drive roller that is the one roller of the first transport roller pair, and a rotating shaft of the driven blade is positioned downstream of a rotating shaft of a driven roller that is the other roller of the first transport roller pair in the transport direction.

4. The slit device according to claim 3, wherein the cutting position is provided at a position overlapping the drive roller when viewed from a direction orthogonal to the transport direction.

5. The slit device according to claim 3, wherein the driven blade is disposed on the second transport roller pair side with respect to the driving blade, the driven blade forms a trapezoid when viewed from the transport direction, and a size of a surface of the driven blade on the second transport roller pair side is smaller than a size of a surface of the driven blade on the driving blade side.

6. The slit device according to claim 2, wherein a size of a surface of the other roller of the second transport roller pair facing the first transport roller pair is smaller than a size of a surface opposite to the surface facing the first transport roller pair.

7. A sheet manufacturing apparatus comprising the slit device according to claim 1.

* * * * *